US011867399B2

(12) United States Patent
Kim

(10) Patent No.: US 11,867,399 B2
(45) Date of Patent: Jan. 9, 2024

(54) MICRO-MIXER AND COMBUSTOR HAVING THE SAME

(71) Applicant: DOOSAN ENERBILITY CO., LTD., Changwon-si (KR)

(72) Inventor: Eun Young Kim, Seoul (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 17/510,280

(22) Filed: Oct. 25, 2021

(65) Prior Publication Data

US 2022/0205636 A1 Jun. 30, 2022

(30) Foreign Application Priority Data

Dec. 31, 2020 (KR) ..... 10-2020-0189786

(51) Int. Cl.
*F23R 3/28* (2006.01)
*F23R 3/34* (2006.01)

(52) U.S. Cl.
CPC ..... *F23R 3/286* (2013.01); *F23R 3/34* (2013.01); *F23R 2900/00014* (2013.01)

(58) Field of Classification Search
CPC ..... F23R 3/286; F23R 3/34–346; F23R 2900/00014; F05D 2260/96; F05D 2260/963–964; F05D 2260/2212; F23D 14/62–70; F23D 11/101–102; F23D 11/12–14
See application file for complete search history.

(56) References Cited

U.S. PATENT DOCUMENTS 6,311,471 B1 * 11/2001 Waldherr ..... F23R 3/283 60/39.55
2003/0031972 A1 * 2/2003 Griffin ..... F23R 3/286 431/354
2003/0110774 A1 * 6/2003 Saitoh ..... F23R 3/14 60/737
2005/0161028 A1 * 7/2005 Wolters ..... F02M 21/042 137/896
2009/0188255 A1 * 7/2009 Green ..... F23R 3/286 60/737
2013/0227953 A1 * 9/2013 Uhm ..... F02C 3/30 60/738
2013/0269351 A1 10/2013 Hu
2016/0033133 A1 2/2016 Johnson
2017/0198914 A1 * 7/2017 Baumann ..... F23R 3/343
2019/0285278 A1 * 9/2019 Choi ..... F23R 3/286

FOREIGN PATENT DOCUMENTS

KR 20190108955 A 9/2019

OTHER PUBLICATIONS

KR OA dated Apr. 26, 2022.

* cited by examiner

*Primary Examiner* — Stephanie Sebasco Cheng
*Assistant Examiner* — Jingchen Liu
(74) *Attorney, Agent, or Firm* — Harvest IP Law, LLP

(57) ABSTRACT

A micro-mixer capable of effectively mixing compressed air supplied from a compressor to a combustor and fuel supplied from a fuel nozzle, and a combustor including the same are provided. The micro-mixer includes a mixing passage including an inlet and an outlet, a fuel supply passage extending from one inner wall to the other inner wall of the mixing passage, and a fuel supply port formed in the fuel supply passage to supply fuel to the mixing passage.

17 Claims, 9 Drawing Sheets

MICRO-MIXER AND COMBUSTOR HAVING THE SAME

CROSS REFERENCE TO RELATED APPLICATION

This application claims priority to Korean Patent Application No. 10-2020-0189786, filed on Dec. 31, 2020, the entire disclosure of which is incorporated herein by reference in its entirety.

BACKGROUND

1. Field

Apparatuses and methods consistent with exemplary embodiments relate to a micro-mixer and a combustor having the same.

2. Description of the Related Art

A gas turbine is a combustion engine in which a mixture of air compressed by a compressor and fuel is combusted to produce a high temperature gas which drives a turbine. The gas turbine is used to drive electric generators, aircraft, ships, trains, or the like.

The gas turbine includes a compressor, a combustor, and a turbine. The compressor serves to intake external air, compress the air, and transfer the compressed air to the combustor. The compressed air compressed by the compressor has a high temperature and a high pressure. The combustor serves to mix compressed air compressed by the compressor and fuel and combust the mixture of compressed air and fuel to produce combustion gas discharged to the gas turbine. The combustion gas drives turbine blades in the turbine to produce power. The generated power is applied to a variety of fields such as generation of electricity, driving of mechanical units, etc.

SUMMARY

Aspects of one or more exemplary embodiments provide a micro-mixer capable of effectively mixing compressed air supplied from a compressor to a combustor and fuel supplied from a fuel nozzle, and a combustor including the same.

Additional aspects will be set forth in part in the description which follows and, in part, will become apparent from the description, or may be learned by practice of the exemplary embodiments.

According to an aspect of an exemplary embodiment, there is provided a micro-mixer including: a mixing passage including an inlet and an outlet; a fuel supply passage extending from one inner wall to the other inner wall of the mixing passage; and a fuel supply port formed in the fuel supply passage to supply fuel to the mixing passage.

The fuel supply port may be provided toward the outlet of the mixing passage.

The fuel supply passage may be formed in multiple units such that the fuel supply passages are formed to cross each other when viewed from the outlet to the inlet.

The fuel supply passage may be formed upstream of the mixing passage, and a fluid mixer may be formed downstream of the mixing passage to mix a mixed fluid flowing toward the outlet.

The fluid mixer may include a plurality of baffle members sequentially spaced apart from each other in a direction from the inlet to the outlet, each of the baffle members having a different opening pattern.

The fluid mixer may include a plurality of mesh members sequentially spaced apart from each other in a direction from the inlet to the outlet, each of the mesh members having a different opening pattern.

The fluid mixer may include a plurality of steel wire members sequentially spaced apart from each other in a direction from the inlet to the outlet, each of the steel wire members extending in a different direction.

According to an aspect of another exemplary embodiment, there is provided a combustor including: a combustion chamber assembly including a combustion chamber in which a fuel fluid combusts; and a micro-mixer assembly including a plurality of micro-mixers to inject the fuel fluid into the combustion chamber, each of the micro-mixer including: a mixing passage including an inlet and an outlet; a fuel supply passage extending from one inner wall to the other inner wall of the mixing passage; and a fuel supply port formed in the fuel supply passage to supply fuel to the mixing passage.

The fuel supply port may be provided toward the outlet of the mixing passage.

The fuel supply passage may be formed in multiple units such that the fuel supply passages are formed to cross each other when viewed from the outlet to the inlet.

The fuel supply passage may be formed upstream of the mixing passage, and a fluid mixer may be formed downstream of the mixing passage to mix a mixed fluid flowing toward the outlet.

The fluid mixer may include a plurality of baffle members sequentially spaced apart from each other in a direction from the inlet to the outlet, each of the baffle members having a different opening pattern.

The fluid mixer may include a plurality of mesh members sequentially spaced apart from each other in the direction from the inlet to the outlet, each of the mesh members having a different opening pattern.

The fluid mixer may include a plurality of steel wire members sequentially spaced apart from each other in a direction from the inlet to the outlet, each of the steel wire members extending in a different direction.

The micro-mixer assembly may further include: a micro-mixer bundle in which the plurality of micro-mixers are disposed; an insertion hole into which the micro-mixer bundle is inserted; and a damping spring provided between the micro-mixer bundle and the insertion hole.

According to an aspect of another exemplary embodiment, there is provided a gas turbine including: a compressor configured to compress air; a combustor configured to mix the air compressed by the compressor with fuel to produce a mixed fuel fluid and combust the mixed fuel fluid; and a turbine rotated by the combustion gas produced by the combustor to generate power, wherein the combustor including: a combustion chamber assembly including a combustion chamber in which the fuel fluid combusts; and a micro-mixer assembly including a plurality of micro-mixers to inject the fuel fluid into the combustion chamber, wherein each of the micro-mixers including: a mixing passage including an inlet and an outlet; a fuel supply passage extending from one inner wall to the other inner wall of the mixing passage; and a fuel supply port formed in the fuel supply passage to supply fuel to the mixing passage.

The fuel supply port may be provided toward the outlet of the mixing passage.

The fuel supply passage may be formed in multiple units such that the fuel supply passages are formed to cross each other when viewed from the outlet to the inlet.

The fuel supply passage may be formed upstream of the mixing passage, and a fluid mixer may be formed downstream of the mixing passage to mix a mixed fluid flowing toward the outlet. The fluid mixer may include a plurality of baffle members, mesh members, or steel wire members sequentially spaced apart from each other in a direction from the inlet to the outlet, each of the baffle members or each of the mesh members having a different opening pattern, and each of the steel wire members may extend in a different direction.

The micro-mixer assembly may further include: a micro-mixer bundle in which the plurality of micro-mixers are disposed; an insertion hole into which the micro-mixer bundle is inserted; and a damping spring provided between the micro-mixer bundle and the insertion hole.

According to one or more exemplary embodiments, compressed air supplied from the compressor to the combustor can be effectively mixed with the fuel supplied from the fuel nozzle.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
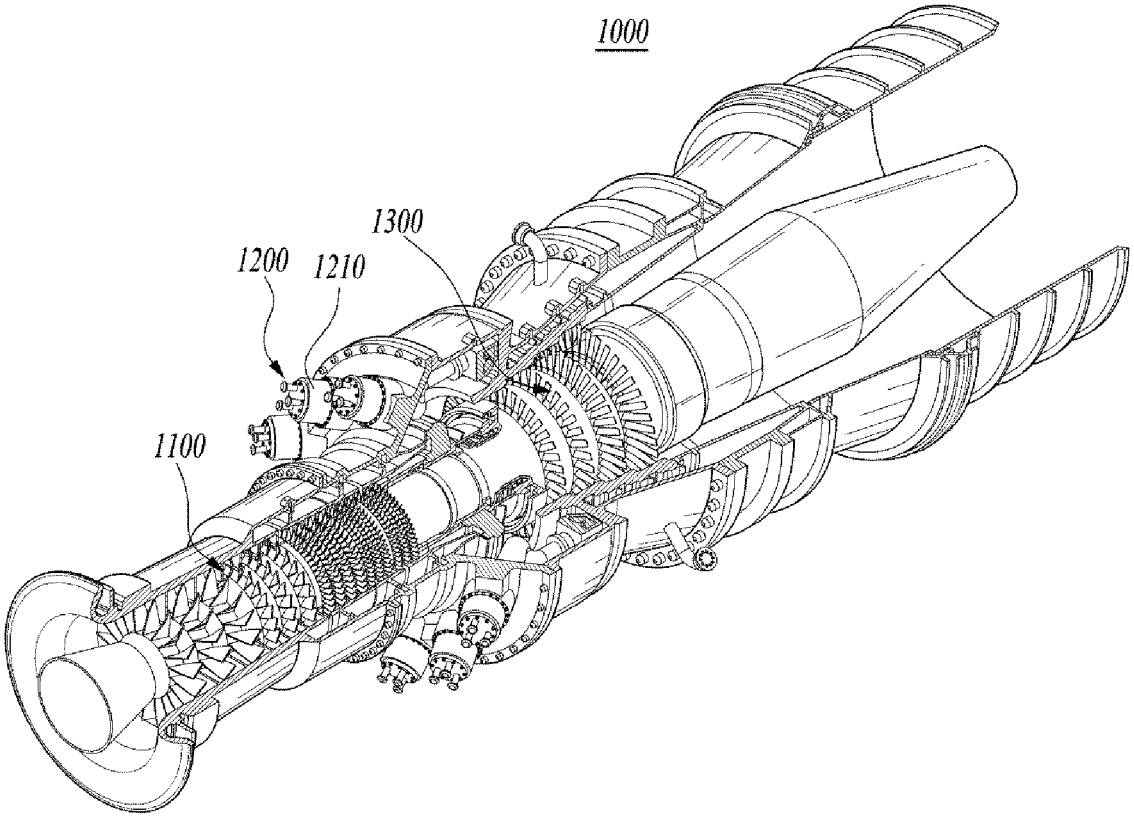
FIG. 1 is a view illustrating an interior of a gas turbine according to an exemplary embodiment.

Various modifications and various embodiments will be described in detail with reference to the accompanying drawings. However, it should be noted that the various embodiments are not for limiting the scope of the disclosure to the specific embodiment, but they should be interpreted to include all of modifications, equivalents or substitutions of the embodiments included within the spirit and scope disclosed herein.

Terms used herein are used to merely describe specific embodiments, and are not intended to limit the scope of the disclosure. As used herein, an element expressed as a singular form includes a plurality of elements, unless the context clearly indicates otherwise. Further, it will be understood that the term "including" or "including" specifies the presence of stated features, numbers, steps, operations, elements, parts, or combinations thereof, but does not preclude the presence or addition of one or more other features, numbers, steps, operations, elements, parts, or combinations thereof.

Hereinafter, exemplary embodiments will be described in detail with reference to the accompanying drawings. It is noted that like reference numerals refer to like parts throughout the various figures and exemplary embodiments. In certain embodiments, a detailed description of known functions and configurations that may obscure the gist of the present disclosure will be omitted. For the same reason, some of the elements in the drawings are exaggerated, omitted, or schematically illustrated.

Hereinafter, a gas turbine according to a first exemplary embodiment will be described with reference to the accompanying drawings.

Figure 2:
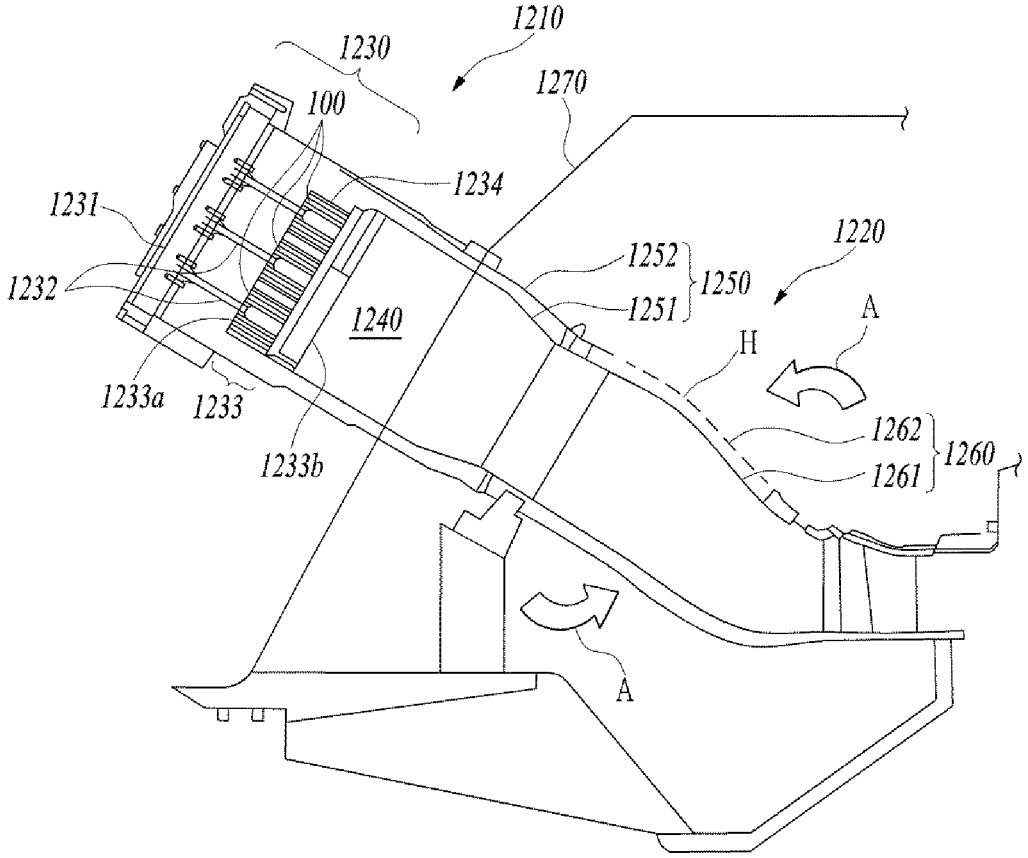
FIG. 2 is a view illustrating a burner module constituting a combustor according to an exemplary embodiment.
Figure 3:
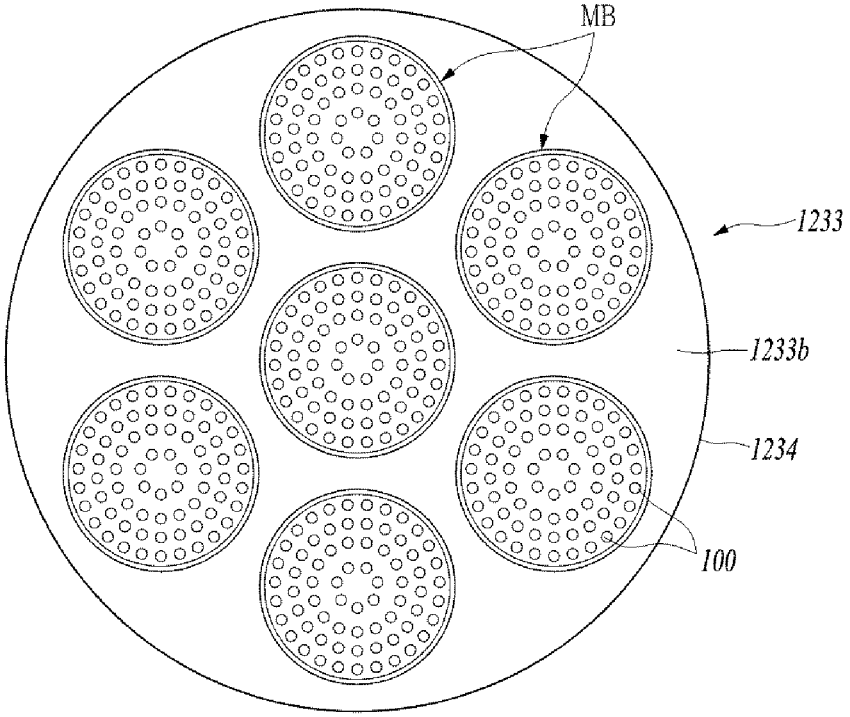
FIG. 3 is a view illustrating a lower surface of an end cap that is a part of the burner module according to an exemplary embodiment.

FIG. 1 is a view illustrating an interior of a gas turbine according to an exemplary embodiment, FIG. 2 is a view illustrating a burner module constituting a combustor according to an exemplary embodiment, and FIG. 3 is a view illustrating a lower surface of an end cap that is a part of the burner module according to an exemplary embodiment.

Referring to FIGS. 1 to 3, a gas turbine 1000 includes a compressor 1100 that compresses incoming air to a high pressure, a combustor 1200 that mixes compressed air compressed by the compressor with fuel and combusts an air-fuel mixture, and a turbine 1300 that generates rotational force with combustion gas generated in the combustor. Here, upstream and downstream are defined based on a front and rear of the fuel or air flow.

An ideal thermodynamic cycle of a gas turbine may ideally comply with the Brayton cycle. The Brayton cycle consists of four thermodynamic processes: isentropic compression (i.e., an adiabatic compression) process, isobaric combustion process, isentropic expansion (i.e., an adiabatic expansion) process and isobaric heat ejection process. That is, in the Brayton cycle, thermal energy may be released by combustion of fuel in an isobaric environment after atmospheric air is sucked and compressed into high pressure air, hot combustion gas may be expanded to be converted into kinetic energy, and exhaust gas with residual energy may be discharged to the outside. As such, the Brayton cycle consists of four thermodynamic processes including compression, heating, expansion, and exhaust.

The gas turbine 1000 employing the Brayton cycle includes the compressor 1100, the combustor 1200, and the turbine 1300. Although the following description will be described with reference to FIG. 1, the present disclosure may be widely applied to other turbine engines having similar configurations to the gas turbine 1000 illustrated in FIG. 1.

Referring to FIG. 1, the compressor 1100 of the gas turbine may suck and compress air. The compressor 1100 may supply the compressed air to the combustor 1200 and also supply cooling air to a high temperature region of the gas turbine that is required to be cooled. Because the sucked air is compressed in the compressor 1100 through an adiabatic compression process, the pressure and temperature of the air passing through the compressor 1100 increases.

The compressor 1100 may be designed in a form of a centrifugal compressor or an axial compressor, wherein the centrifugal compressor is applied to a small-scale gas turbine, whereas a multi-stage axial compressor is applied to a large-scale gas turbine 1000 illustrated in FIG. 1 to compress a large amount of air.

The compressor 1100 is driven using a portion of the power output from a turbine 1300. To this end, as illustrated in FIG. 1, a rotary shaft of the compressor 1100 and a rotary shaft of the turbine 1300 may be directly connected. In the case of the large-scale gas turbine 1000, almost half of the output produced by the turbine 1300 may be consumed to drive the compressor 1100. Accordingly, improving the efficiency of the compressor 1100 has a direct effect on improving the overall efficiency of the gas turbine 1000.

The combustor 1200 may mix the compressed air supplied from an outlet of the compressor 1100 with fuel and combust the mixture at constant pressure to produce combustion gas with high energy.

The combustor 1200 is disposed downstream of the compressor 1100 and includes a plurality of burner modules 1210 annually disposed around a center axis thereof.

Referring to FIG. 2, the burner module 1210 may include a combustion chamber assembly 1220 having a combustion chamber 1240 in which a fuel fluid burns, and a micro-mixer assembly 1230 having a plurality of micro-mixers for injecting the fuel fluid into the combustion chamber 1240.

The gas turbine 1000 may use gas fuel, liquid fuel, or a combination thereof. In order to create a combustion environment for reducing emissions such as carbon monoxides or nitrogen oxides, a gas turbine has a recent tendency to apply a premixed combustion scheme that is advantageous in reducing emissions through lowered combustion temperature and homogeneous combustion even though it is difficult to control the premixed combustion.

In case of premixed combustion, in the micro-mixer assembly 1230, the compressed air introduced from the compressor 1100 is mixed with fuel in advance, and then enters to the combustion chamber 1240. When the premixed gas is initially ignited by an igniter and then a combustion state is stabilized, the combustion state is maintained by supplying fuel and air.

Referring to FIGS. 2 and 3, the micro-mixer assembly 1230 includes a plurality of micro-mixer bundles MB in which a plurality of micro-mixers 100 for spraying a mixed fuel fluid are disposed. The micro-mixer 100 mixes fuel with air in an appropriate ratio to form a fuel-air mixture having conditions suitable for combustion.

The plurality of micro-mixer bundles MB may include a single inner micro-mixer bundle and a plurality of circumferential micro-mixer bundles radially arranged around the inner micro-mixer bundle.

The combustion chamber assembly 1220 includes a combustion chamber 1240 in which combustion occurs, a liner 1250 and a transition piece 1260.

The liner 1250 disposed on a downstream side of the micro-mixer assembly 1230 may have a dual structure of an inner liner part 1251 and an outer liner part 1252 in which the inner liner part 1251 is surrounded by the outer liner part 1252. In this case, the inner liner part 1251 is a hollow tubular member, and the combustion chamber 1240 is an internal space of the inner liner part 1251. The inner liner part 1251 is cooled by the compressed air introduced into an annular space inside the outer liner part 1252 through inlet holes H.

The transition piece 1260 is disposed on a downstream side of the liner 1250 to guide the combustion gas generated in the combustion chamber 1240 toward the turbine 1300. The transition piece 1260 may have a dual structure of an inner transition piece part 1261 and an outer transition piece part 1262 in which the inner transition piece part 1261 is surrounded by the outer transition piece part 1262. The inner transition piece part 1261 is also formed of a hollow tubular member such that a diameter gradually decreases from the liner 1250 toward the turbine 1300. In this case, the inner liner part 1251 and the inner transition piece part 1261 may be coupled to each other by a plate spring seal. Because respective ends of the inner liner part 1251 and the inner transition piece part 1261 are fixed to the combustor 1200 and the turbine 1300, respectively, the plate spring seal may have a structure capable of accommodating expansion of length and diameter by thermal expansion to support the inner liner part 1251 and the inner transition piece part 1261.

As such, the inner liner part 1251 and the inner transition piece part 1261 have a structure surrounded by the outer liner part 1252 and the outer transition piece part 1262, respectively so that compressed air may flow into the annular space between the inner liner part 1251 and the outer liner part 1252 and into the annular space between the inner transition piece part 1261 and the outer transition piece part 1262. The compressed air introduced into the annular spaces may cool the inner liner part 1251 and the inner transition piece part 1261.

In the meantime, high temperature and high pressure combustion gas generated by the combustor 1200 is supplied to the turbine 1300 through the liner 1250 and the transition piece 1260. In the turbine 1300, the combustion gas undergoes adiabatic expansion and impacts and drives a plurality of blades arranged radially around a rotary shaft of the turbine 1300 so that thermal energy of the combustion gas is converted into mechanical energy with which the rotary shaft rotates. A portion of the mechanical energy obtained from the turbine 1300 is supplied as the energy required to compress the air in the compressor 1100, and the remaining is utilized as an available energy to drive a generator to produce electric power The combustor 1200 may further include a casing 1270 and an end cover 1231 coupled together to receive the compressed air A flowing into the burner module 1210. After the compressed air A flows into the annular space inside the liner 1250 or the transition piece 1260 through the inlet holes H, the flow direction of the compressed air A is changed by the end cover 1231 to the inside of the micro-mixer 100. The fuel is supplied to the micro-mixer 100 via a fuel plenum 1235 through a fuel passage 1232 and may be mixed with compressed air.

The micro-mixers 100 are radially arranged in an end cap 1233 upstream of the combustion chamber 1240. The end cap 1233 has an upper surface 1233*a* and a lower surface 1233*b*. A shroud 1234 is formed to surround the end cap 1233. The micro-mixer 100 is formed to extend from the upper surface 1233*a* to the lower surface 1233*b* of the end cap 1233. The compressed air A flows into the combustion chamber 1240 through the micro-mixers 100 formed in the end cap 1233.

Figure 4:
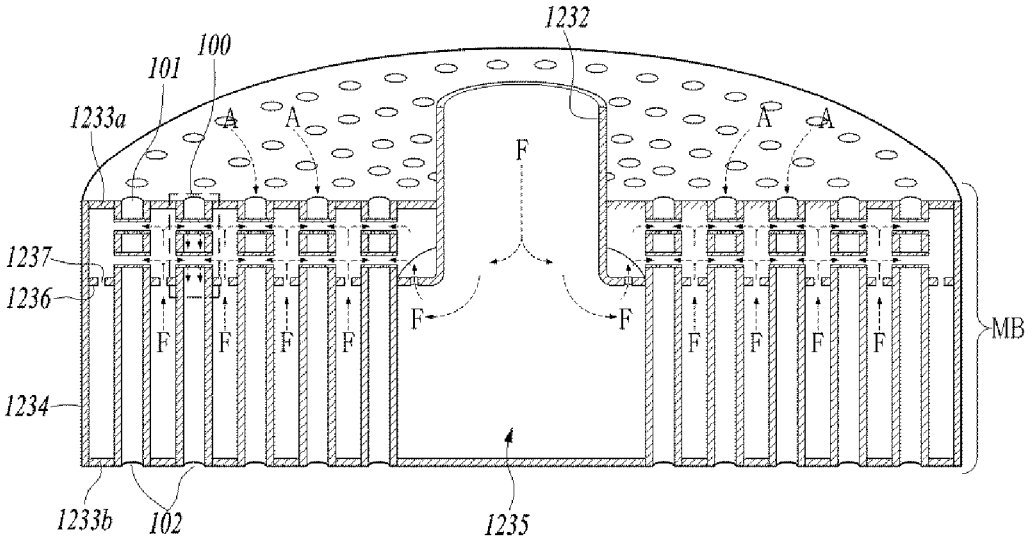
FIG. 4 is a side cross-sectional view illustrating a micro-mixer bundle according to an exemplary embodiment.

FIG. 4 is a side cross-sectional view illustrating a micro-mixer bundle according to an exemplary embodiment.

Referring to FIG. 4, the micro-mixer bundle MB is formed to extend in a radial direction with respect to the fuel passage 1232, and the micro-mixer 100 is formed to extend from the upper surface 1233*a* to the lower surface 1233*b* of the end cap 1233. The micro-mixer 100 has an inlet 101 formed in the upper surface 1233*a* and an outlet 102 formed in the lower surface 1233*b*.

The upper surface 1233*a* and the lower surface 1233*b* of the end cap 1233, and the shroud 1234 form a fuel plenum 1235. The fuel plenum 1235 includes a baffle 1236 defining a fuel path through which the fuel F flows into the micro-mixer 100. The baffle 1236 has a baffle hole 1237 through which the fuel is introduced into the micro-mixer 100.

Figure 5:
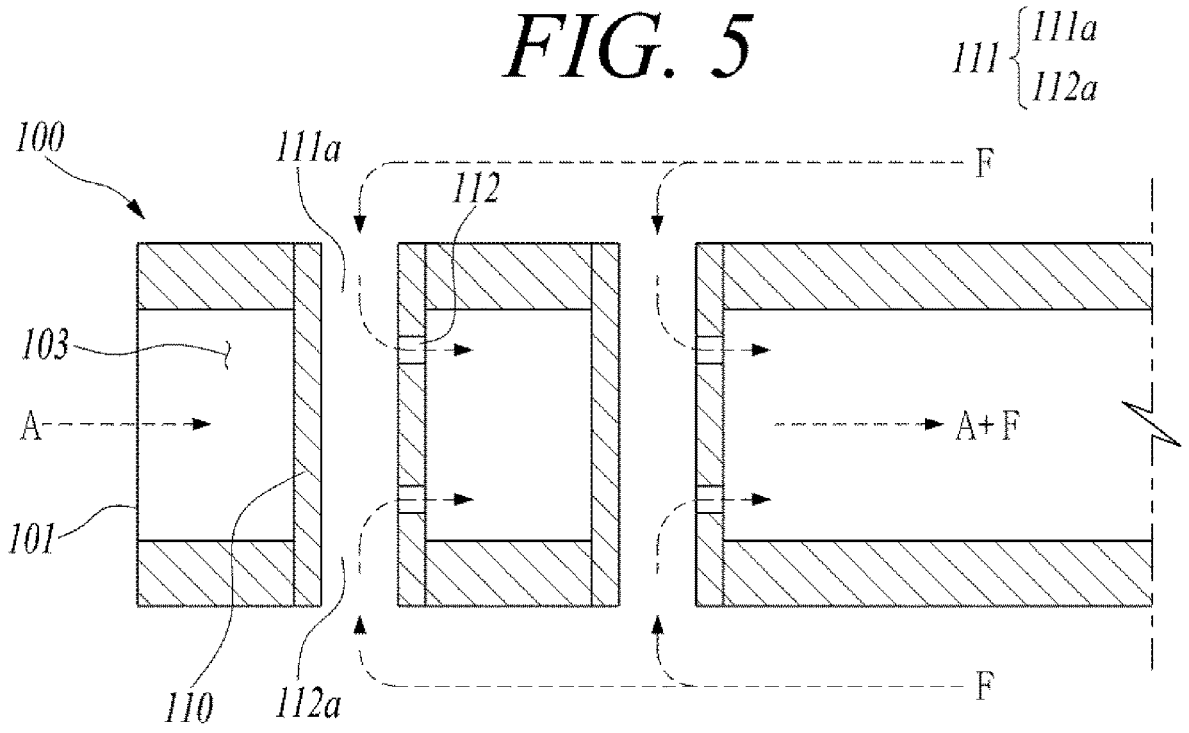
FIG. 5 is a side cross-sectional view illustrating a micro-mixer according to a first exemplary embodiment.

Hereinafter, a micro-mixer according to a first exemplary embodiment will be described with reference to FIGS. 5 to 7. FIG. 5 is a side cross-sectional view illustrating the micro-mixer according to the first exemplary embodiment, FIG. 6 is a side cross-sectional view illustrating a modified example of the micro-mixer according to the first exemplary embodiment, and FIG. 7 is a view illustrating the micro-mixer according to the first exemplary embodiment as viewed from the outlet to the inlet thereof.

Figure 6:
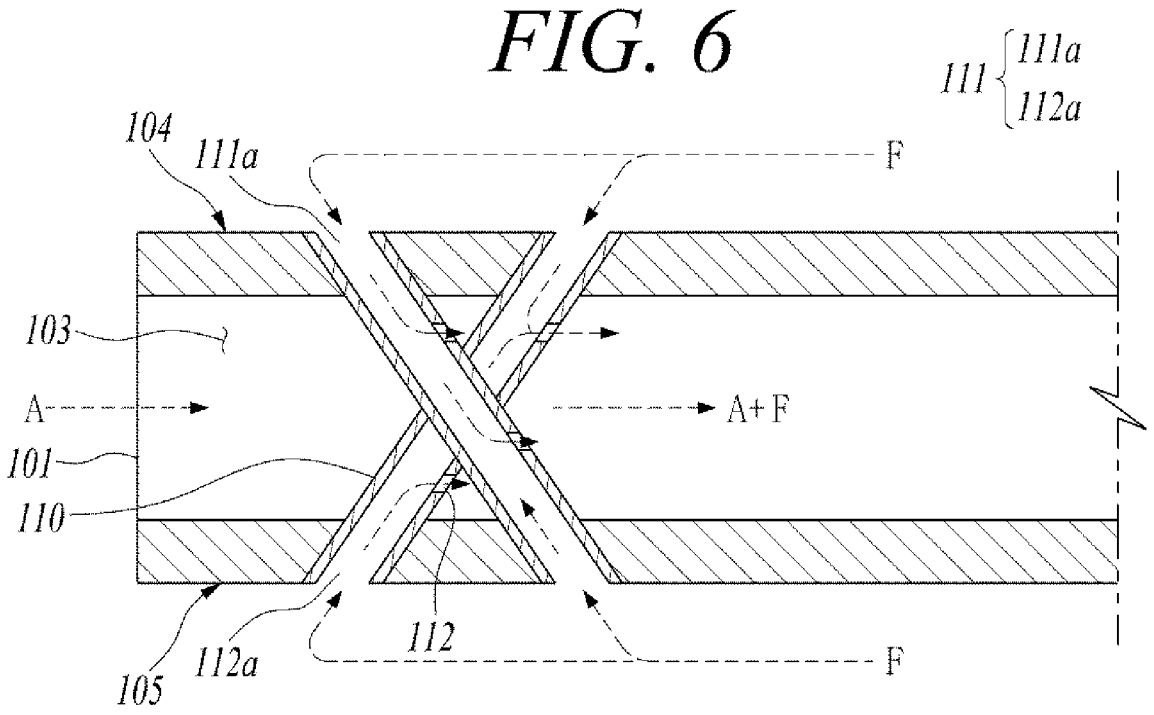
FIG. 6 is a side cross-sectional view illustrating a modified example of the micro-mixer according to the first exemplary embodiment.
Figure 7:
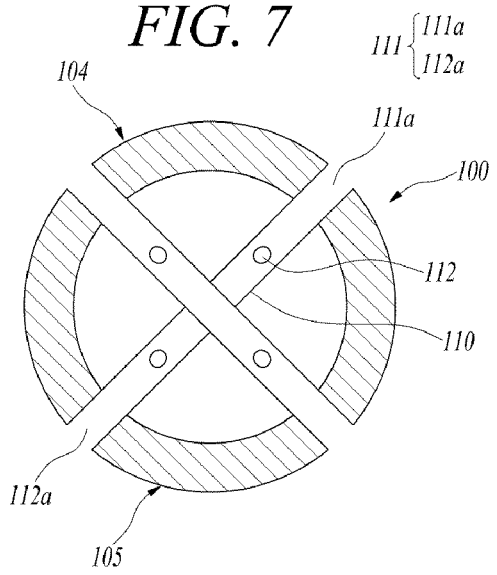
FIG. 7 is a view illustrating the micro-mixer according to the first exemplary embodiment as viewed from an outlet to an inlet thereof.

Referring to FIGS. 5 to 7, the micro-mixer 100 includes a mixing passage 103, a fuel supply passage 110, and a fuel supply port 112.

The mixing passage 103 is formed to extend from the upper surface 1233*a* toward the lower surface 1233*b* of the end cap 1233 and has the inlet 101 formed in the upper surface 1233*a* and the outlet 102 formed in the lower surface 1233*b*. Compressed air A is introduced through the inlet 101, and a mixture A+F of compressed air A and fuel F flows into the combustion chamber 1240 through the outlet 102.

The fuel supply passage 110 is formed to extend from one inner wall 104 to the other inner 105 wall of the mixing passage 103. At least one fuel supply passage 110 may be formed across the mixing passage 103.

The fuel supply passage 110 may be formed of a plurality of units, which may be configured to be parallel to each other as shown in FIG. 5 or may be configured to cross each other as shown in FIG. 6.

As illustrated in FIG. 7, when the micro-mixer 100 is viewed from the outlet 102 to the inlet 101, the fuel supply passages 110 may be configured to cross each other. It is understood that this does not mean that the fuel supply passages intersect in a real three-dimensional space.

The fuel supply passage 110 is provided with a fuel inlet port 111 and a fuel supply port 112. The fuel inlet port 111 allows the fuel F introduced through the baffle hole 1237 to flow into the fuel supply passage 110. The fuel supply port 112 allows the fuel introduced into the fuel supply passage 110 to be supplied to the mixing passage 103 so that the compressed air A introduced from the inlet 101 and the fuel F are mixed. If the fuel supply port 112 is formed toward the inlet 101, the compressed air A may be supplied into the fuel supply port 112. Therefore, the fuel supply port 112 is preferably formed toward the outlet 102.

Hereinafter, a micro-mixer according to a second exemplary embodiment will be described with reference to FIGS. 8 to 10.

Figure 8:
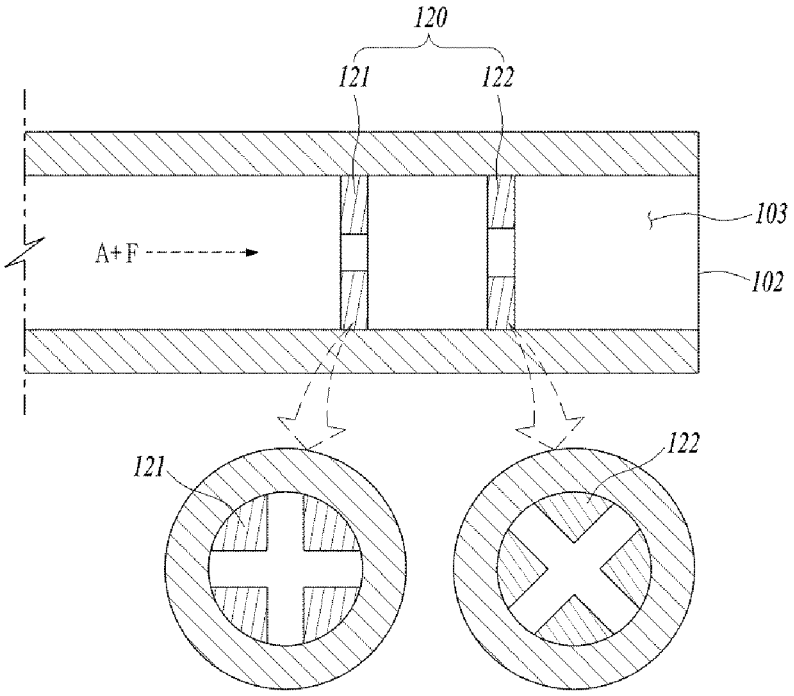
FIGS. 8 to 10 are side cross-sectional views illustrating various modifications of a micro-mixer according to a second exemplary embodiment.
Figure 9:
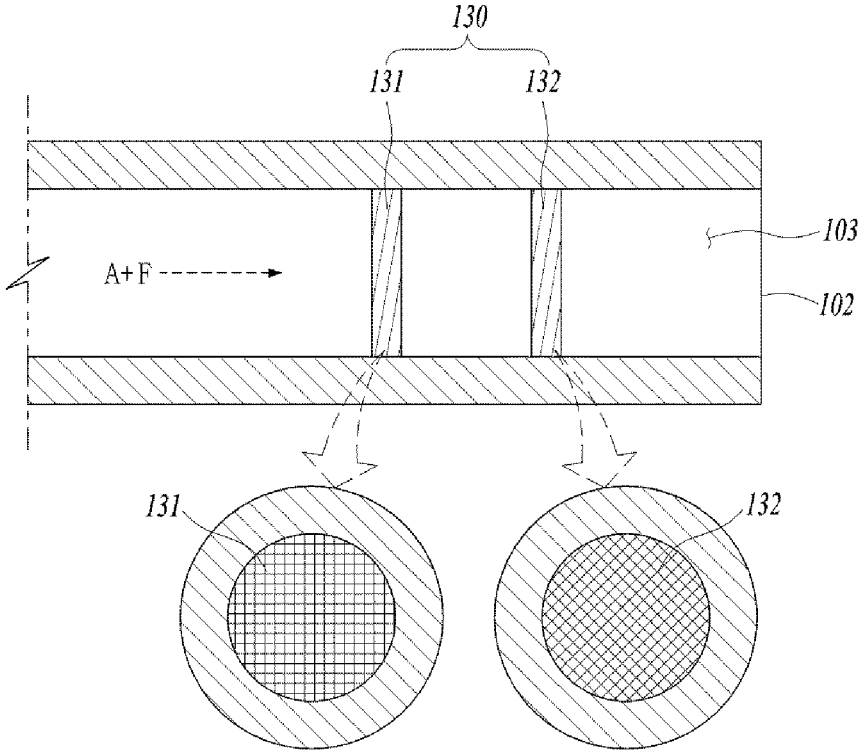
Figure 10:
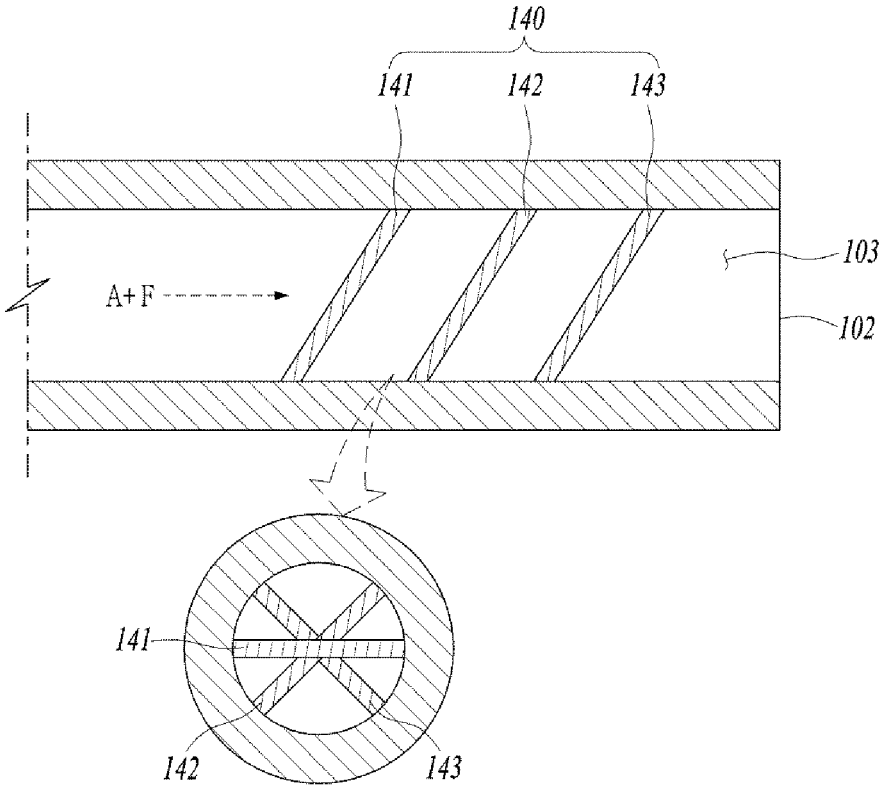

FIGS. 8 to 10 are side cross-sectional views illustrating various modifications of the micro-mixer according to a second exemplary embodiment.

Referring to FIGS. 8 to 10, the micro-mixer may further include fluid mixers 120, 130, and 140 formed downstream of the mixing passage 103.

In FIGS. 8 to 10 according to the second exemplary embodiment, the mixture A+F of compressed air A and fuel F mixed upstream of the mixing passage 103 according to the first exemplary embodiment flows in the direction of the outlet 102, and the mixture A+F may be further mixed by the fluid mixers 120, 130, and 140.

The fluid mixer 120 may include a plurality of baffle members. Each of the baffle members may be provided with a different opening pattern. The baffle members may be sequentially spaced apart from the inlet 101 toward the outlet 102 of the mixing passage 103. FIG. 8 illustrates two baffle members 121 and 122, and it is understood that more or less than two baffle members may be included in one or more other embodiments.

Referring to FIG. 8, the fluid mixer 120 may include a first baffle member 121 and a second baffle member 122 which may be sequentially spaced apart from the inlet 101 toward the outlet 102 of the mixing passage 103. The first baffle member 121 may have a first pattern, and the second baffle member 122 may have a second pattern different from the first pattern. For example, the first baffle member 121 may have a first pattern having a cross-shaped (+) opening, and the second baffle member 122 may have a second pattern having an X-shaped opening.

Referring to FIG. 9, the fluid mixer 130 may include a plurality of mesh members. Each of the mesh members may be provided with a different pattern. The mesh members may be sequentially spaced apart from the inlet 101 toward the outlet 102 of the mixing passage 103. FIG. 9 illustrates two mesh members 131 and 132, and it is understood that more or less than two mesh members may be included in one or more other embodiments.

The fluid mixer 130 may include a first mesh member 131 and a second mesh member 132 which may be sequentially spaced apart from the inlet 101 toward the outlet 102 of the mixing passage 103. The first mesh member 131 may have a first pattern, and the second mesh member 132 may have a second pattern different from the first pattern. For example, the first mesh member 131 may have a first pattern having a cross-shaped (+) opening, and the second mesh member 132 may have a second pattern having an X-shaped opening.

Referring to FIG. 10, the fluid mixer 140 may include a plurality of steel wire members. Each of the steel wire members may be formed to extend from one inner wall to the other inner wall of the mixing passage 103. Each of the steel wire members may be formed in different directions. The steel wire members may be sequentially spaced apart from the inlet 101 toward the outlet 102 of the mixing passage 103. FIG. 10 illustrates three steel wire members 141, 142, and 143, and it is understood that more or less than three steel wire members may be included in one or more other embodiments.

The fluid mixer 140 may include three steel wire members 141, 142, and 143 which may be sequentially spaced apart from the inlet 101 toward the outlet 102 of the mixing passage 103. The first steel wire member 141 may be formed in a first direction, the second steel wire member 142 may be formed in a second direction different from the first direction, and the third steel wire member 143 may be formed in a third direction different from the first and second directions.

The mixture A+F mixed according to the first exemplary embodiment may be further mixed while flowing to the outlet 102 by the fluid mixers 120, 130, and 140 according to the second exemplary embodiment, thereby improving the mixing efficiency of fluids.

Figure 11:
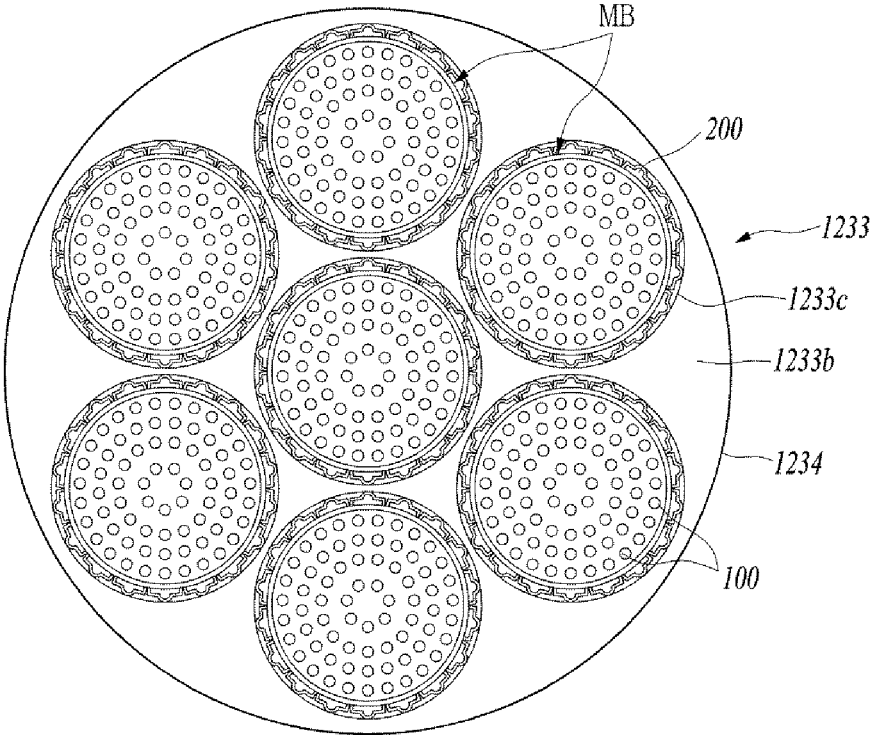
FIG. 11 is a view illustrating a modified example of the lower surface of the end cap according to an exemplary embodiment.

Next, a modified example of the micro-mixer assembly will be described with reference to FIG. 11. FIG. 11 is a view illustrating a modified example of the lower surface of the end cap according to an exemplary embodiment.

Referring to FIG. 11, the micro-mixer bundles MB may be inserted into an insertion hole 1233*c* of the end cap 1233. In this case, there is a risk that the lower ends of the micro-mixer bundles MB continuously and repeatedly collide with the inner wall of the insertion hole 1233*c* and are damaged due to vibrations generated during operation of the gas turbine.

Accordingly, the micro-mixer assembly may further include a damping spring 200 formed between the micro-mixer bundle MB and the insertion hole 1233*c* of the end cap 1233. The damping spring 200 may be provided on an outer peripheral surface of the micro-mixer bundle MB or may be provided on an inner wall of the insertion hole 1233*c*. The damping spring 200 may absorb vibrations generated during operation of the gas turbine to prevent damage to the micro-mixer bundle MB.

While one or more exemplary embodiments have been described with reference to the accompanying drawings, it will be apparent to those skilled in the art that various modifications and variations can be made through addition, change, omission, or substitution of components without departing from the spirit and scope of the disclosure as set forth in the appended claims, and these modifications and changes fall within the spirit and scope of the disclosure as defined in the appended claims.

What is claimed is:

1. A micro-mixer comprising:

a mixing passage formed in a cylindrical shape by a wall and extending from an inlet to an outlet along a central axis;

a first fuel supply passage disposed inside of the mixing passage and extending from a first fuel inlet port formed on a first location on the wall of the mixing passage to a second fuel inlet port formed on a second location one the of the wall of the mixing passage, wherein a first portion of a fuel is supplied radially inward from outside of the wall to the first fuel supply passage through the first fuel inlet port and through the second fuel inlet port relative to the central axis;

a second fuel supply passage disposed in the mixing passage and extending from a third fuel inlet port formed on a third location on the wall of the mixing passage to a fourth fuel inlet port formed on a fourth location on the wall of the mixing passage, wherein a second portion of the fuel is supplied radially inward from outside of the wall to the second fuel supply passage through the third fuel inlet port and through the fourth fuel inlet port relative to the central axis;

a first fuel supply port formed in the first fuel supply passage to supply the first portion of the fuel to the mixing passage; and a second fuel supply port formed in the second fuel supply passage to supply the second portion of the fuel to the mixing passage, wherein both of the first fuel inlet port and the third fuel inlet port are formed axially upstream from both of the second fuel inlet port and the fourth fuel inlet port relative to the central axis such that the first fuel supply passage and the second fuel supply passage appear to cross each other without physically intersecting into each other.

2. The micro-mixer according to claim 1, wherein the first and second fuel supply ports are facing toward the outlet of the mixing passage.

3. The micro-mixer according to claim 1, wherein a fluid mixer is formed in the mixing passage axially downstream of the first and second fuel supply passages to further mix the first and second portions of the fuel with an air flowing toward the outlet.

4. The micro-mixer according to claim 3, wherein the fluid mixer includes a plurality of baffle members, wherein each of the plurality of baffle member is sequentially spaced apart from each other relative to the central axis and has an opening pattern that is different from each other.

5. The micro-mixer according to claim 3, wherein the fluid mixer includes a plurality of mesh members, wherein each of the plurality of mesh member is sequentially spaced apart from each other relative to the central axis and has an opening pattern that is different from each other.

6. The micro-mixer according to claim 3, wherein the fluid mixer includes a plurality of steel wire members, wherein each of the plurality of steel wire member extends across the mixing passage in a respective radial direction that is different from each other and is sequentially spaced apart from each other relative to the central axis.

7. A combustor comprising:

a combustion chamber assembly comprising a combustion chamber in which a fuel fluid combusts; and a micro-mixer assembly comprising a plurality of micro-mixers to inject the fuel fluid into the combustion chamber, each of the plurality of micro-mixers comprising:

a mixing passage formed in a cylindrical shape by a wall and extending from an inlet to an outlet along a central axis;

a first fuel supply passage disposed inside of the mixing passage and extending from a first fuel inlet port formed on a first location on the wall of the mixing passage to a second fuel inlet port formed on a second location on the wall of the mixing passage, wherein a first portion of the fuel fluid is supplied radially inward from outside of the wall to the first fuel supply passage through the first fuel inlet port and through the second fuel inlet port relative to the central axis;

a second fuel supply passage disposed in the mixing passage and extending from a third fuel inlet port formed on a third location on the wall of the mixing passage to a fourth fuel inlet port formed on a fourth location on the wall of the mixing passage, wherein a second portion of the fuel fluid is supplied radially inward from outside of the wall to the second fuel supply passage through the third fuel inlet port and through the fourth fuel inlet port relative to the central axis;

a first fuel supply port formed in the first fuel supply passage to supply the first portion of the fuel fluid to the mixing passage; and a second fuel supply port formed in the second fuel supply passage to supply the second portion of the fuel fluid to the mixing passage, wherein both of the first fuel inlet port and the third fuel inlet port are formed axially upstream from both of the second fuel inlet port and the fourth fuel inlet port relative to the central axis such that the first fuel supply passage and the second fuel supply passage appear to cross each other without physically intersecting into each other.

8. The combustor according to claim 7, wherein, for each of the plurality of micro-mixers, the first and second fuel supply ports are facing toward the outlet of the mixing passage.

9. The combustor according to claim 7, wherein, for each of the plurality of micro-mixers, a fluid mixer is formed in the mixing passage axially downstream of the first and second fuel supply passages to further mix the first and second portions of the fuel fluid with an air flowing toward the outlet.

10. The combustor according to claim 9, wherein, for each of the plurality of micro-mixers, the fluid mixer includes a plurality of baffle members, wherein each of the plurality of baffle member is sequentially spaced apart from each other relative to the central axis and has an opening pattern that is different from each other.

11. The combustor according to claim 9, wherein, for each of the plurality of micro-mixers, the fluid mixer includes a plurality of mesh members, wherein each of the plurality of mesh member is sequentially spaced apart from each other relative to the central axis and has an opening pattern that is different from each other.

12. The combustor according to claim 9, wherein, for each of the plurality of micro-mixers, the fluid mixer includes a plurality of steel wire members, wherein each of the plurality of steel wire member extends across the mixing passage in a respective direction that is different from each other and is sequentially spaced apart from each other relative to the central axis.

13. The combustor according to claim 7, wherein the micro-mixer assembly further comprises:

a micro-mixer bundle in which the plurality of micro-mixers are disposed;

an insertion hole into which the micro-mixer bundle is inserted; and a damping spring provided between the micro-mixer bundle and the insertion hole.

14. A gas turbine comprising:

a compressor configured to compress air;

a combustor configured to mix the compressed air with a fuel fluid to produce a mixed fuel fluid and combust the mixed fuel fluid; and a turbine rotated by a combustion gas produced by combusting the mixed fuel fluid in the combustor to generate power, wherein the combustor comprising:

a combustion chamber assembly comprising a combustion chamber in which the mixed fuel fluid combusts; and a micro-mixer assembly comprising a plurality of micro-mixers to inject the mixed fuel fluid into the combustion chamber, wherein each of the plurality of micro-mixers comprises:

a mixing passage formed in a cylindrical shape by a wall and extending from an inlet to an outlet along a central axis;

a first fuel supply passage disposed inside of the mixing passage and extending from a first fuel inlet port formed on a first location on the wall of the mixing passage to a second fuel inlet port formed on a second location on the wall of the mixing passage, wherein a first portion of the fuel fluid is supplied radially inward from outside of the wall to the first fuel supply passage through the first fuel inlet port and through the second fuel inlet port relative to the central axis;

a second fuel supply passage disposed in the mixing passage and extending from a third fuel inlet port formed on a third location on the wall of the mixing passage to a fourth fuel inlet port formed on a fourth location on the wall of the mixing passage, wherein a second portion of the fuel fluid is supplied radially inward from outside of the wall to the second fuel supply passage through the third fuel inlet port and through the fourth fuel inlet port relative to the central axis;

a first fuel supply port formed in the first fuel supply passage to supply the first portion of the fuel fluid to the mixing passage; and a second fuel supply port formed in the second fuel supply passage to supply the second portion of the fuel fluid to the mixing passage, wherein both of the first fuel inlet port and the third fuel inlet port are formed axially upstream from both of the second fuel inlet port and the fourth fuel inlet port relative to the central axis such that the first fuel supply passage and the second fuel supply passage appear to cross each other without physically intersecting into each other.

15. The gas turbine according to claim 14, wherein, for each of the plurality of micro-mixers, the first and second fuel supply ports are facing toward the outlet of the mixing passage.

16. The gas turbine according to claim 14, wherein, for each of the plurality of micro-mixers, a fluid mixer is formed in the mixing passage axially downstream of the first and second fuel supply passages to further mix the first and second portions of the fuel fluid with a portion of the compressed air flowing toward the outlet, wherein the fluid mixer includes a plurality of baffle members, mesh members, or steel wire members, wherein each of the plurality of baffle members, mesh members, or steel wire members is sequentially spaced apart from each other relative to the central axis, each of the plurality of baffle members or each of the plurality of mesh members has an opening pattern that is different from each other, and each of the plurality of steel wire members extends across the mixing passage in a respective radial direction that is different from each other.

17. The gas turbine according to claim 14, wherein the micro-mixer assembly further comprises:

a micro-mixer bundle in which the plurality of micro-mixers are disposed;

an insertion hole into which the micro-mixer bundle is inserted; and a damping spring provided between the micro-mixer bundle and the insertion hole.

* * * * *